US006601423B1

(12) United States Patent
Peterson

(10) Patent No.: US 6,601,423 B1
(45) Date of Patent: Aug. 5, 2003

(54) FABRICATION OF BENT TUBING

(75) Inventor: Ivan Harry Peterson, Auburn, NH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/135,948

(22) Filed: Apr. 30, 2002

(51) Int. Cl.[7] ..... B21D 39/20; B21D 26/02
(52) U.S. Cl. ..... 72/58; 72/62; 29/421.1
(58) Field of Search ..... 72/58, 62, 61; 29/421.1

(56) References Cited

U.S. PATENT DOCUMENTS 1,542,983 A * 6/1925 Bergmann ..... 72/58
3,247,581 A * 4/1966 Pellizzari ..... 72/62
3,303,680 A 2/1967 Thielsch ..... 72/58
5,303,570 A * 4/1994 Kaiser ..... 72/62
5,737,953 A 4/1998 Allison et al. ..... 72/58
5,927,119 A 7/1999 Hamano et al. ..... 72/58
5,953,945 A 9/1999 Horton ..... 72/58

* cited by examiner

*Primary Examiner*—David Jones
(74) *Attorney, Agent, or Firm*—V. Ramaswamy; Gregory A. Welte

(57) ABSTRACT

An approach to restoring the cross-section of a bent tube to circularity. The tube is placed into a fixture, so that pressurization does not remove the bend. Liquid is placed into the tube, and pressurized. Pressure is increased until the wall of the tube undergoes plastic deformation, and becomes circular.

15 Claims, 7 Drawing Sheets

FABRICATION OF BENT TUBING

FIELD OF THE INVENTION

The invention relates to fabrication of complex tubing structures which carry pressurized fluids. An example of such a structure is found in a fuel manifold in a gas turbine engine.

BACKGROUND OF THE INVENTION

FIG. 1 is a partial schematic of a fuel manifold 3 used in a gas turbine engine (not shown). Tubes 6, which were originally straight when manufactured, are bent into the shapes shown using known procedures. The bent tubes 6 are connected to connectors 9.

Brazed joints (not shown) are often used to bond tubes 6 to connectors 9. If brazed joints are used, problems can arise which will be explained by reference to FIGS. 2–5.

FIG. 2 illustrates in schematic form a hollow tube 12. When the tube 12 is bent into the curved shape 15 shown in FIG. 3, the cross section becomes elliptical, as illustrated in exaggerated form by ellipse 18.

The deviation of ellipse 18 from a perfect circle is small: the major diameter 21 of the ellipse is greater than the minor diameter 24 by only a few percent, such as one or two percent. However, this small deviation from perfect circularity can create faulty braze joints.

For example, in FIG. 4, circle 14 represents a sleeve of a connector 9 in FIG. 1, and ellipse 16 represents tube 15 in FIG. 2. If the latter is inserted into the former, as in assembly 30, then contact may occur in region 36, because of a tight fit. The molten brazing alloy may not penetrate between the two components in region 36, causing a weak spot, and possible leakage. In addition, in order to create an ideal braze joint, a uniform distance 39 in FIG. 5 should exist between the two components 17 and 18 to be brazed. If one of the components is elliptical, as in FIG. 4, then this uniform distance 39 cannot be achieved.

Further, tube-to-tube variations further increase the non-uniformity. That is, a given bent tube 15 in FIG. 2 may fit tightly in region 36 in FIG. 4, while a second, supposedly identical, bent tube may not.

The inventor has developed a process for reducing the problems just described.

SUMMARY OF THE INVENTION

In one form of the invention, liquid is placed into a bent tube of elliptical cross-section. The liquid is pressurized to a pressure which causes the hoop stress in the tube to exceed the plastic deformation limit of the tube material. The tube is thereby deformed into a circular cross section.

DETAILED DESCRIPTION OF THE INVENTION

Figure 6:
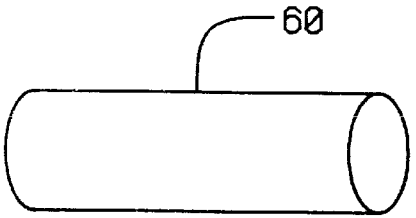

FIG. 6 illustrates a plan view of a seamless, drawn tube 60, constructed of number 321 stainless steel, and having 40 percent ductility. The tube is 0.5 inches in outer diameter, 60 inches long, and has a wall thickness of 0.028 inches. Such tubes are commercially available, and are used in fabrication of fuel manifolds in gas turbine engines.

Figure 7:
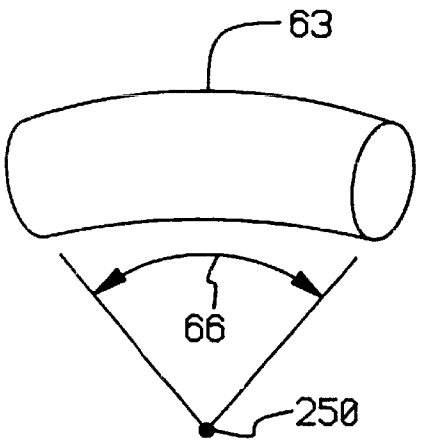

The tube 60 is bent into a curved shape 63 shown in FIG. 7, using a standard tubing bender (not shown). While the bender is designed to capture the tube, and eliminate the flattening into the elliptical cross-section described above, the bending process is not perfect, and flattening does occur. In one form of the invention, bent tube 63 spans 180 degrees of arc, represented by angle 66.

Figure 8:
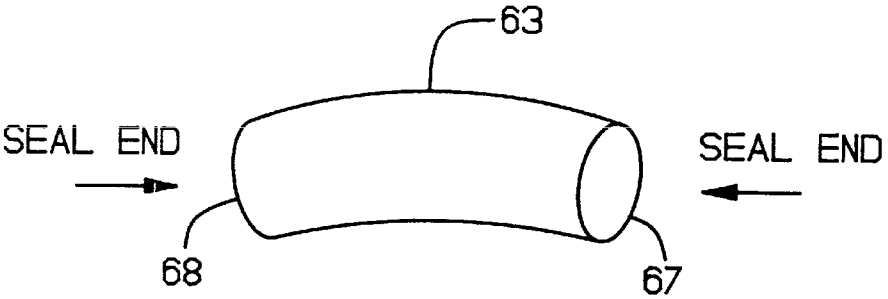
FIGS. 6, 7, 8, 9, 10, 13, 15, and 16 illustrate processing steps undertaken by one form of the invention.

Next, the ends 67 and 68 of tube 60 are sealed, as indicated in FIG. 7. In one mode of sealing, caps 72 and 74 in FIG. 8 are brazed, or welded, to the tube 60. Cap 74 is equipped with an orifice 76 to admit liquid into tube 60.

Figure 10:
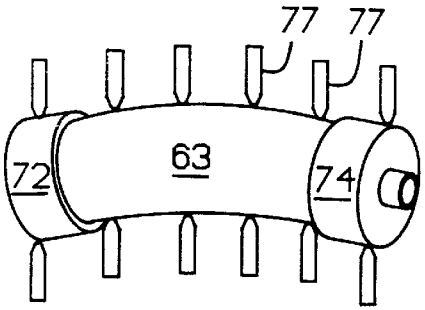

The tube 60 is then placed into a fixture, represented by rigid fingers 77, in FIG. 10. This fixture can take numerous different configurations, and serves to prevent the tube 60 from expanding like a Bourdon tube during the pressurization which will be described below.

Figure 11:
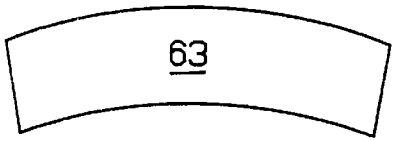
FIGS. 11 and 12 illustrate how a Bourdon tube straightens when pressurized.
Figure 12:
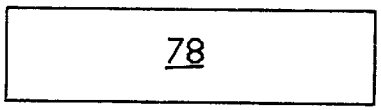

That is, as shown in FIG. 11, if the tube 63 were not constrained by the fingers 77, shown in FIG. 10, pressurization would cause the tube 63 in FIG. 11 to attempt to straighten into the rectangular shape 78 shown in FIG. 12.

Figure 13:
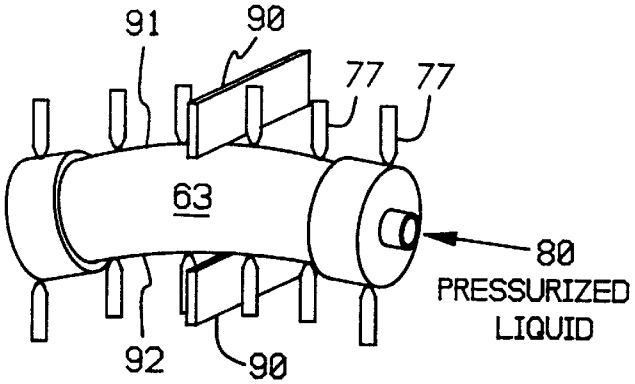

After placement into the fixture, pressurized liquid 80 in FIG. 13, which is preferably water, is introduced into tube 63, through orifice 76. The liquid 80 is initially pressurized to a pressure of 4,100 pounds per square inch, PSI.

In developing the invention, the Inventor undertook to ascertain the bursting strength of the tube under discussion, for safety reasons and other purposes. The Inventor ascertained that the tube has a bursting strength of 9100 pounds per square inch, PSI, or greater.

Figure 2:
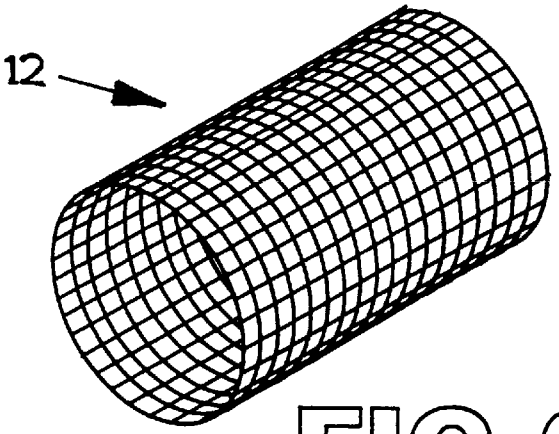
FIG 2 PRIOR ART
FIG. 2 illustrates a tube used in the manifold of FIG. 1.
Figure 3:
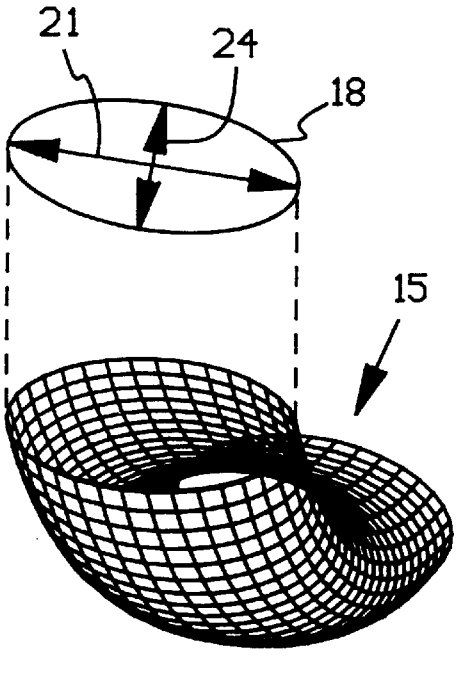
FIG 3 PRIOR ART
FIG. 3 illustrates how bending of the tube causes the cross-section to become elliptical.
Figure 1:
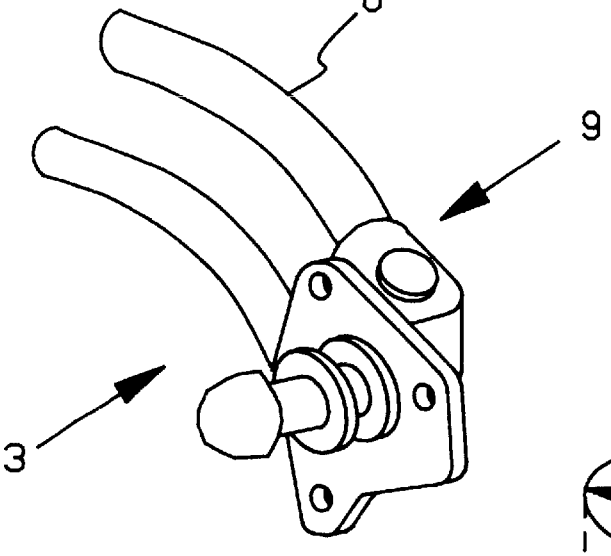
FIG 1 PRIOR ART
FIG. 1 illustrates a partial schematic of a fuel manifold for a gas turbine engine.
Figure 4:
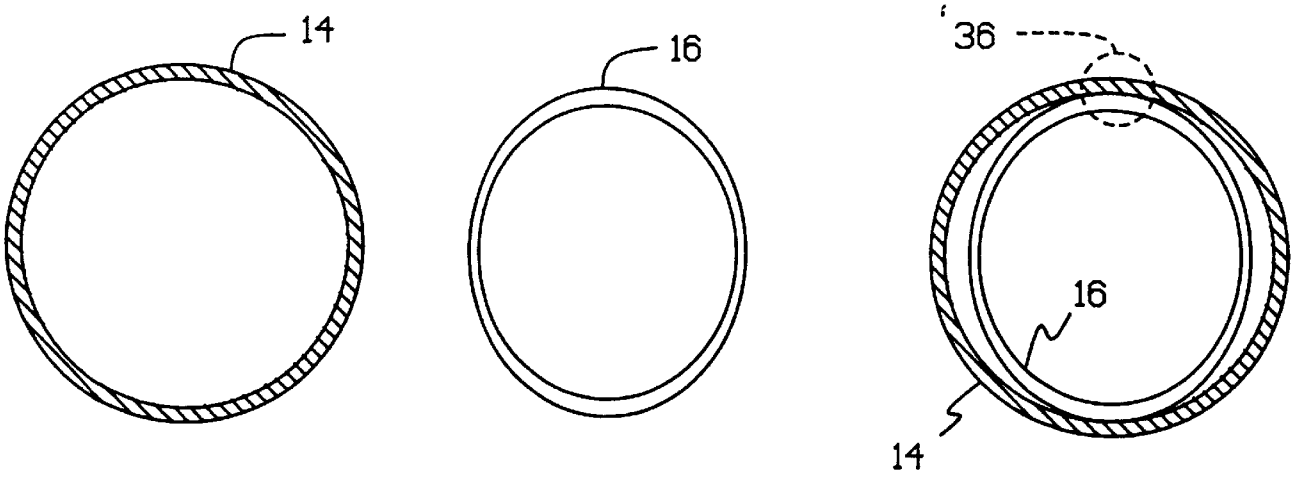
FIG. 4 illustrates a problem which arises when an elliptical tube is placed into a circular fitting.
Figure 5:
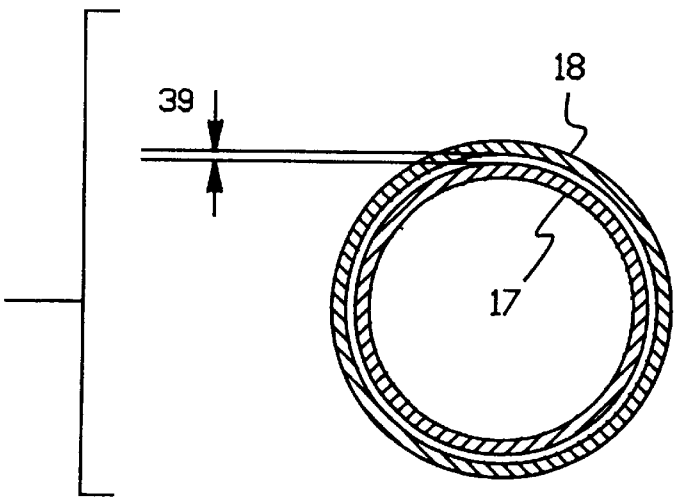
FIG. 5 illustrates the ideal case of a tube within a fitting.

After the initial pressurization, the pressure of the liquid 80 is progressively increased, while the minor diameter of the tube 63 in FIG. 13 is continually measured using a caliper, which is represented by anvils 90. Distance 24 in FIG. 3 represents a minor diameter.

The Inventor has observed that one of the first events to occur is that the minor diameter will increase to the size of the major diameter. That is, as pressure is increased, the tube 63 becomes sufficiently circular for proper brazing. Then, further pressurization causes the now circular tube 63 to increase in overall diameter, but to remain circular.

Restated, the Inventor has found that the internal pressure will cause the material of the tube in the region of the minor diameter to plastically deform into a circular configuration, while the major diameter remains substantially constant. The plastic deformation, by definition, is permanent.

The Inventor submits that this finding is somewhat surprising, since the tube 63 in FIG. 13 is bent, or arcuate. That is, from a theoretical viewpoint, each cross-section of the tube 63 is an ellipse. However, in reality, that is not so, because the outer surface 91 of the tube is longer than the inner surface 92. Thus, the cross sections are not perfectly elliptical.

Nevertheless, the processing described above drives tube 63 into a cross-sectional shape which is circular within 5 percent. Restated, in one embodiment, an outer diameter of 0.5 inches is attained at all locations, with an error of +/−0.0025 inches.

Figure 14:
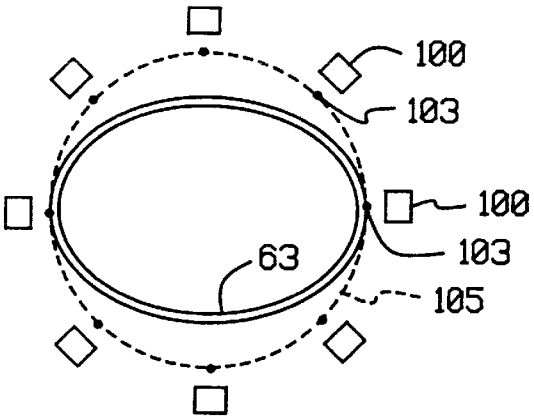
FIG. 14 illustrates pressure sensors 100 which measure circularity of tube 63.

The caliper represented by anvils 90 can measure more than one diameter during the process just described, or multiple calipers can be used simultaneously. In addition, other approaches for detecting the attainment of a circular cross-section can be implemented. For example, optical proximity sensors 100 in FIG. 14 can be used.

Each sensor 100 detects the presence of an object at a respective target point 103. An array of such sensors 100 can detect when tube 63 deforms into the circular shape represented by dashed circle 105, upon which the target points 103 are situated.

Plastic deformation of the tube 63 under discussion has been found to begin at a liquid pressure of 4300 PSI. Of course, variations are to be expected, even for tubes of identical nominal dimensions and material.

Figure 9:
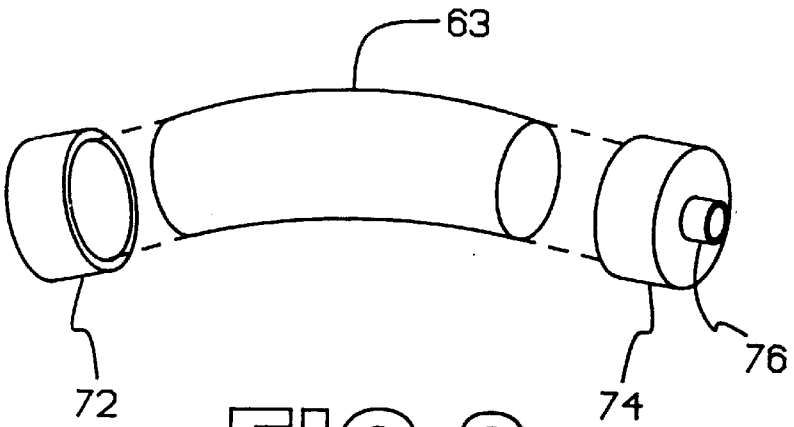
Figure 15:
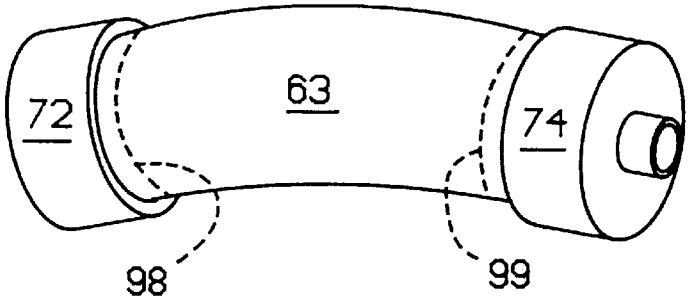
Figure 16:
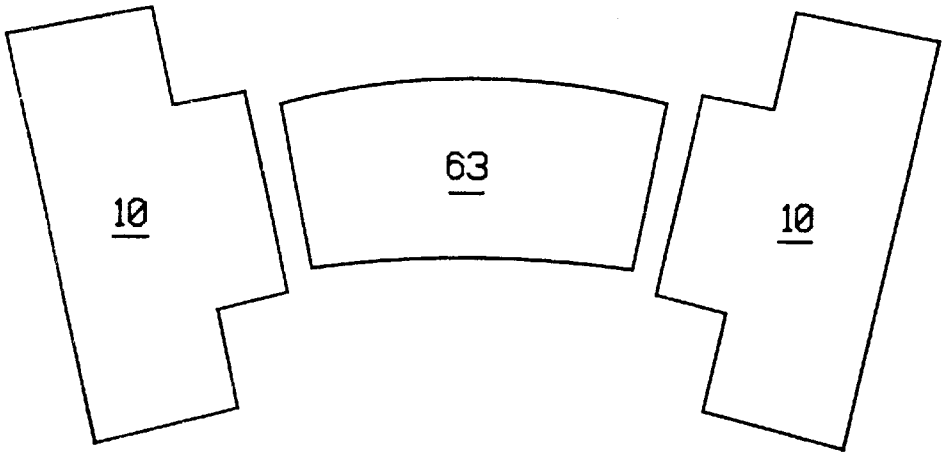

After the tube 63 attains the desired circular cross-section, it is removed from the fixture, and then from the sealing system of FIGS. 8 and 9, as by making cuts 98 and 99 in FIG. 15. The tube 63 is then brazed onto the appropriate T-connectors 10, schematically indicated in FIG. 16.

Figure 17:
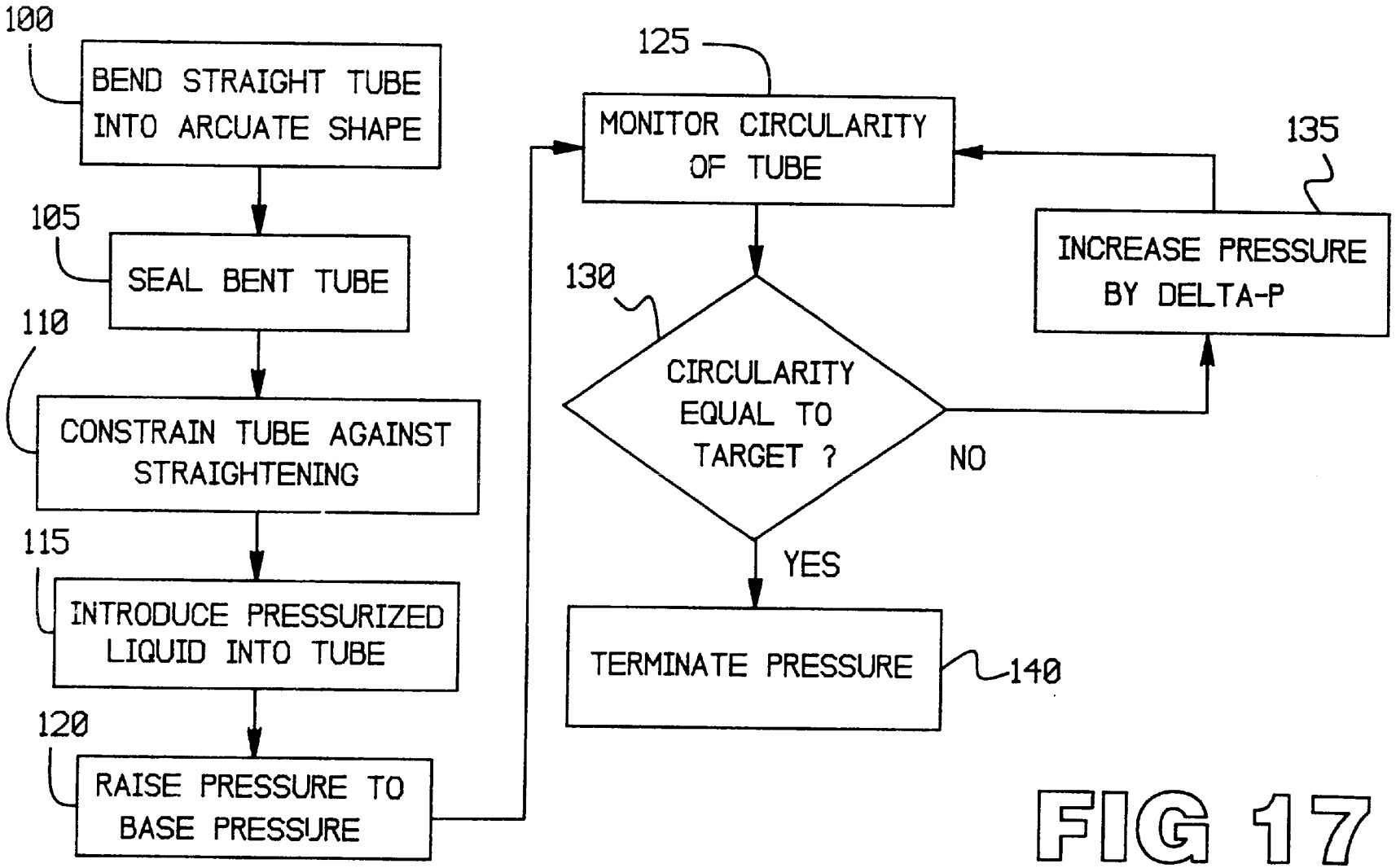
FIG. 17 is a flow chart of processing undertaken by one form of the invention.

FIG. 17 is a flow chart of processes undertaken in one form of the invention. In block 100, a straight tube of circular cross-section is bent into an arcuate shape. FIG. 7 shows such an arcuate shape. In block 105 in FIG. 17, the bent tube is sealed, as indicated in FIG. 8. In block 110 in FIG. 17, the bent tube is placed into a constraining fixture, to prevent Bourdon-type deformation. FIG. 10 represents one type of constraint.

In block 115 in FIG. 17, pressurized liquid is introduced into the bent tube, as indicated in FIG. 13.

In one form of the invention, pressurized liquid is used, rather than a pressurized gas. One reason is that, if the bent tube should rupture, the pressurized liquid will only expand an infinitesimal amount and, at worst, eject a small stream of liquid for a very short time.

However, if pressurized gas were used, the now-released gas will expand dramatically, possibly causing the tube to explode like a bomb. While precautions can be taken to protect against such events, it is preferred that a pressurized liquid be used, rather than a pressurized gas.

However, certain gases liquify when pressurized. If such a gas is pressurized, and then cooled to room temperature, the pressure vapor pressure will decrease. Such a liquified gas may be considered as a working fluid in one embodiment of the invention. Of course, the liquid will be used, and not the vapor.

It should be pointed out that, if the liquified gas is not cooled, it will still possess the danger of explosion described above. The reason is that, during the compression process, the temperature of the compressed gas will increase. As the compressed gas condenses into a liquid, the temperature will further increase because of liberation of the latent heat of vaporization.

If the liquified gas in this state is allowed to expand, it will do so almost immediately. In contrast, if the liquified gas is first cooled, then, for such an expansion to occur, the gas must absorb significant heat from the environment, in order to both vaporize and then expand. Such absorption is a time-consuming process, and will inhibit explosive expansion.

Therefore, while liquid water is preferred as the working fluid, other liquids can be used, such as hydraulic fluid, and some gases, if condensed into liquid, can be used. In this connection, the Inventor points out that liquid water can be viewed as a condensed vapor, namely, steam.

In block 120 in FIG. 17, the liquid is pressurized to a base pressure, termed P1. Next, a processing loop is undertaken. In block 125, circularity of the tube is monitored, as by measuring the minor diameter, as in FIG. 13. Decision block 130 inquires whether the desired circularity of the tube has been attained, as by inquiring whether the minor diameter has reached a target diameter. If not, the NO branch is taken, block 135 is reached, wherein the pressure is increased by an increment, represented by delta-P. Suitable increments are integral numbers of PSI, such as 1 PSI, 2 PSI, and so on. In one embodiment, increments of 25 PSI were used. The pressures to which these incremental increases raise the internal pressure can be termed, P2, P3, and so on.

The increments need not be uniform, and may change as the minor diameter is found to converge toward the target.

The loop returns to block 125, wherein circularity is again measured. The loop, represented by blocks 125, 130, and 135, continues until the desired circularity is reached, whereupon the YES branch is taken, and block 140 is reached. Block 140 terminates pressure in the tube.

Figure 18:
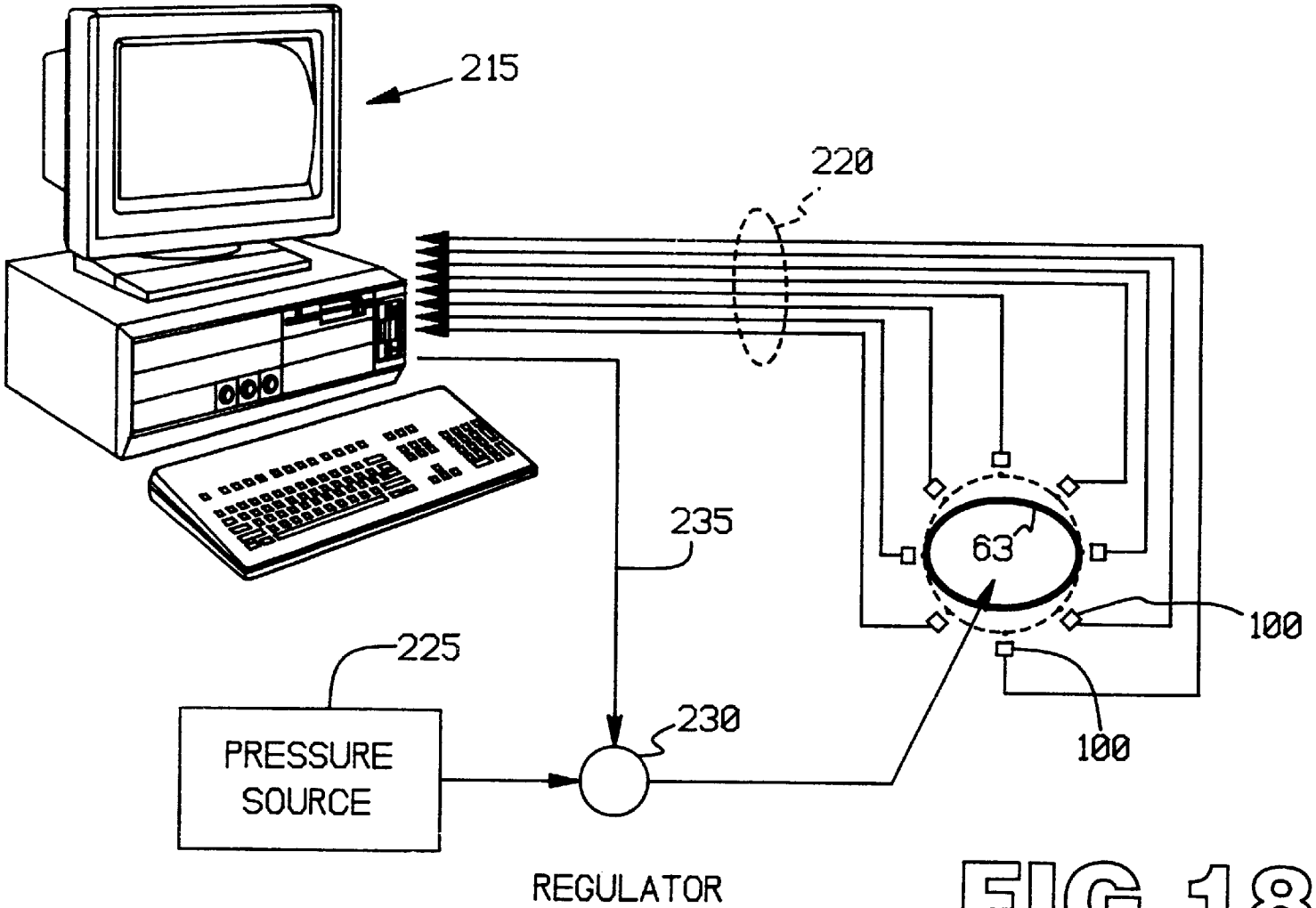
FIG. 18 illustrates one form of the invention.

In one form of the invention, the pressurization process described above is automated, as illustrated by the apparatus in FIG. 18. One or more indicators 100 measure circularity of the tube 63. These indicators 100 can take the form of the optical indicators discussed above. Alternately, they can take the form of commercially available digital dial indicators. Such indicators 200 are commercially available, as from L. S. Starrett Corporation, located in Athol, Massachusetts.

Signals indicating the circularity of tube 63 are fed to a controller in the form of microcomputer 215 on signal lines 220. Microcomputer 215 compares the signals with target values. If the circularity is found to fall short of the target, microcomputer 215 increases pressure of the fluid supplied by a pressure source 225 by adjusting pressure regulator 230 through signals on line 235. When the circularity reaches the target, microcomputer 215 terminates pressure, using regulator 230.

Numerous different control strategies, known in the art, can be undertaken to drive the controlled variable, namely circularity or minor diameter, to a desired target value, by controlling pressure through regulator 230.

In some situations, it may be desirable to introduce overshoot, to account for subsequent relaxation of the material of which the tube 63 is constructed. The relaxation occurs after pressure is terminated. That is, microcomputer 215, or a human operator if the process is not automated, continues to increase pressure until (1) minor diameter or (2) other parameter indicating circularity reaches a predetermined percentage in excess of the desired value. Representative percentages can be 100.5 percent, 101 percent, 101.5 percent, and so on.

After the overshoot is attained, microcomputer 215 terminates pressure. The tube 63 will then relax to a desired percentage of the target radius.

The invention should be distinguished from another process which may appear superficially similar. That process is known as hydroforming. Hydroforming is used in the manufacture of automobile frames. However, in hydroforming, a rectangular channel is pressurized with fluid, and then bent into a desired shape, while still under pressure. Thus, at least three differences become immediately apparent: in hydroforming (1) the channel is rectangular, (2) the final, resulting channel is not circular in cross-section, and (3) the channel is bent while under pressure.

The invention should also be distinguished from processes such as blow molding. In blow molding, a substance such as plastic resin is raised above its melting point, or at least above room temperature, which is taken as 70 degrees F. nominal. Fluid or gas is pumped into the substance to generate a cavity within the substance, and the cavity expands, to force the outer surface of the substance to conform to surface features of a mold in which the substance is encased.

Under the invention, no conformal mold is used to generate surface features, nor is the tube 60 held above its melting point. In one form of the invention, all processes occur at room temperature.

The invention should be further distinguished from the ordinary process of filling a tank with a gas, such as filling a welding tank with hydrogen. Three differences are immediately apparent. One is that, under the invention, the tank is filled with a liquid. Hydrogen is not a liquid. A second is that, under the invention, the entire tube is filled with liquid, and no gas, air, or vapor is present, at least to the extent possible. Again, hydrogen is a gas. A third difference is that, under the invention, the filled tube undergoes plastic deformation. The hydrogen tank, if deformed at all, undergoes elastic deformation. The pressure is not sufficient to reach plastic deformation.

The invention should also be distinguished from operation of a Bourdon tube. In operation, a Bourdon tube does not experience plastic deformation. If it did, then the Bourdon tube would probably become inoperative afterward.

The Inventor points out that the tube 63 in FIG. 7 has two features: (1) an elliptical cross-section and (2) a bend. The bend is not merely a curved surface. That is, a dent in the tube caused by a blow from a hammer could be termed a bend.

But the bend extends along a significant part of the length of the tube. From another perspective, the tube is bent around an external center, represented by point 250 in FIG. 7.

Of course, the bend may be complex, wherein multiple such centers would exist. Further, some centers may be located at infinity. A sweep, which is a term used to describe a bent piece of electrical conduit, provides an example. The sweep can be viewed as a tube containing three parts. It contains two straight sections, which, because of being straight, have centers at infinity. The third part is an elbow, having an external center of bending. The straight tubes are joined to the two ends of the elbow. The bent tube 63 of FIG. 3, if made of electrical conduit, could be called a sweep.

A semantic issue should be addressed. It was stated above that surface 91 in FIG. 13 has a different length than surface 92. It is possible that one, or both, of those lengths may change slightly during the processes described herein. That is, in some embodiments, the circumference of tube 63 in FIG. 14 may change. That change may change the length of surface 91 or 92 or both.

If such a change in length occurs, it could be said that the bend in the tube 63 in FIG. 13 changes, which would be contrary to the statements made above to the effect that the bend does not change.

To resolve this possible issue, the Inventor points out that the arc spanned by the tube 63, as indicated in FIG. 7, does not change. Therefore, the bend does not change. Further, as explained above, the different between the major diameter 21 and the minor diameter 24 in FIG. 3 is only a few percent. Removal of that difference, by making the cross section circular, is not seen as changing the bend in any significant way.

From another perspective, assume that a given tube, prior to processing, will fit into two T-connectors 9 in Figure. If the elliptical cross-section of the tube is removed by using the processes described above, and if that tube will then fit into the same T-connectors, in the same positions, then the bend has not changed.

Numerous substitutions and modifications can be undertaken without departing from the true spirit and scope of the invention. For example, the discussion above has been framed in terms of bending a tube of circular cross-section, to thereby introduce an elliptical cross-section, and then correcting the elliptical cross-section. However, other processes can create the elliptical cross-section beside bending. For example, a diametric force applied to the tube can cause the elliptical cross-section, as when a truck wheel rolls over the tube.

What is desired to be secured by Letters Patent is the invention as defined in the following claims.

What is claimed is:

1. A method of processing a tube having (1) ends of elliptical cross-section and (2) a bend about an external center, comprising:

a) confining the tube so that the bend does not change;

b) pressurizing the tube until the cross-sections become circular.

2. Method according to claim 1, wherein the pressurizing comprises:

c) sealing the tube;

d) introducing a liquid into the tube; and e) pressurizing the liquid.

3. Method according to claim 2, wherein the liquid comprises water.

4. Method according to claim 1, and further comprising:

c) during the pressurizing, monitoring circularity of the tube; and d) terminating pressure when the circularity reaches a target.

5. Method according to claim 1, and further comprising:

c) after the cross-section becomes circular, attaching the tube to a connector having a circular cross-section.

6. Method according to claim 5, and further comprising:

d) repeating processes described in paragraphs (a), (b), and (c), to thereby fabricate a fuel manifold for a gas turbine engine.

7. Method according to claim 1, wherein the process of confining the tube does not confine the tube in a conformal mold.

8. A method, comprising:

a) restraining a tube having a non-circular cross-section;

b) introducing liquid into the tube;

c) increasing pressure of the liquid;

d) monitoring circularity of the tube; and e) when circularity reaches a predetermined level, terminating pressure in the tube.

9. Method according to claim 8, wherein the tube has a bend about an external center, and the process of restraining prevents distortion of the bend as pressure is increased.

10. Method according to claim 8, wherein the tube has two ends, both of non-circular cross section.

11. Method according to claim 8, wherein the process of restraining the tube does not confine the tube in a conformal mold.

12. Method according to claim 9, wherein the process of restraining the tube does not confine the tube in a conformal mold.

13. A method, comprising:

a) placing a sealed tube,
   i) which contains a bend about an external center, and
   ii) has a cross section of elliptical shape, with a minor diameter,
   into a fixture which prevents pressure within the tube from distorting the bend;

b) introducing a liquid into the tube;

c) pressurizing the liquid to a pressure P1;

d) measuring the minor diameter;

e) comparing the minor diameter to a target diameter; and f) progressively increasing the pressure until the minor diameter attains the target diameter.

14. Method according to claims 13, wherein the liquid comprises water.

15. Apparatus, comprising:

a) a fixture for
   i) holding a tube which contains a bend about an external center, and
   ii) preventing deformation of the bend when the tube is pressurized;

b) a pressure source for supplying pressurized liquid to the tube;

c) a regulator for regulating pressure of the liquid within the tube;

d) sensors for producing signals which indicate circularity of the cross-section of the tube; and e) a controller for
   i) receiving the signals;
   ii) determining whether circularity has reached a target and, if not, increasing pressure within the tube by actuating the regulator.

* * * * *